US007191580B2

(12) United States Patent
Schoennagel et al.

(10) Patent No.: US 7,191,580 B2
(45) Date of Patent: Mar. 20, 2007

(54) APPARATUS FOR DEPOSITING A FILAMENT TOW

(75) Inventors: Bernhard Schoennagel, Neumunster (DE); Olaf Schwarz, Neumunster (DE)

(73) Assignee: Neumag Gmbh & Co. KG, Neumunster (DE)

( * ) Notice: Subject to any disclaimer, the term of this patent is extended or adjusted under 35 U.S.C. 154(b) by 0 days.

(21) Appl. No.: 11/470,119

(22) Filed: Sep. 5, 2006

(65) Prior Publication Data

US 2007/0017182 A1 Jan. 25, 2007

Related U.S. Application Data

(62) Division of application No. 10/453,197, filed on Jun. 3, 2003, now Pat. No. 7,107,740.

(30) Foreign Application Priority Data

Jun. 6, 2002 (DE) ..... 102 25 039

(51) Int. Cl.
*B65B 1/04* (2006.01)

(52) U.S. Cl. ..... 53/538; 53/116; 28/289

(58) Field of Classification Search ..... 53/429, 53/467, 473, 475, 116, 537, 538, 170, 173; 28/289

See application file for complete search history.

(56) References Cited

U.S. PATENT DOCUMENTS 2,805,765 A 9/1957 McLean et al.
2,986,781 A 6/1961 Jackson et al.
3,083,437 A 4/1963 Davis, Jr.
3,281,913 A 11/1966 Morehead et al.
3,351,992 A 11/1967 Carter
3,378,898 A 4/1968 Emmons
3,656,383 A 4/1972 Dibble et al.
3,675,409 A 7/1972 Rosenstein
3,807,615 A 4/1974 Crocker
3,846,955 A 11/1974 Mattis
4,248,592 A 2/1981 Salvans et al.
4,327,855 A 5/1982 Lee et al.
5,913,797 A 6/1999 Saleh

FOREIGN PATENT DOCUMENTS

EP 0 875 477 A2 11/1998
EP 1 013 592 A1 6/2000

*Primary Examiner*—Louis Huynh
(74) *Attorney, Agent, or Firm*—Alston & Bird LLP

(57) ABSTRACT

An apparatus for depositing a filament tow in a stationary can. To this end, the filament tow is conveyed to the can by a conveyance means which includes a pair of driven reels. For deposition into the can, the filament tow is guided in such a way that the feed position of the filament tow in the can constantly changes. To allow the filament tow to be deposited with a high filling density, for deposition into the can the filament tow is guided by two separate oscillating motions of the conveyance means during conveying which are transverse to the conveyance direction. In this manner, undesired reactions on the filament tow are advantageously avoided during deposition.

13 Claims, 5 Drawing Sheets

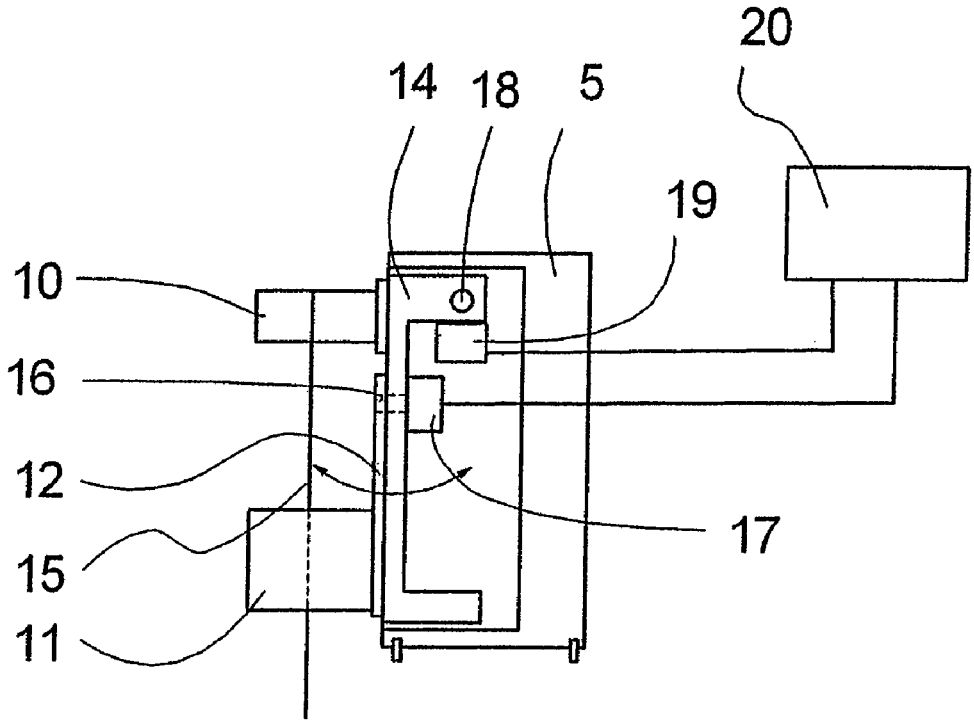
Fig.2.1
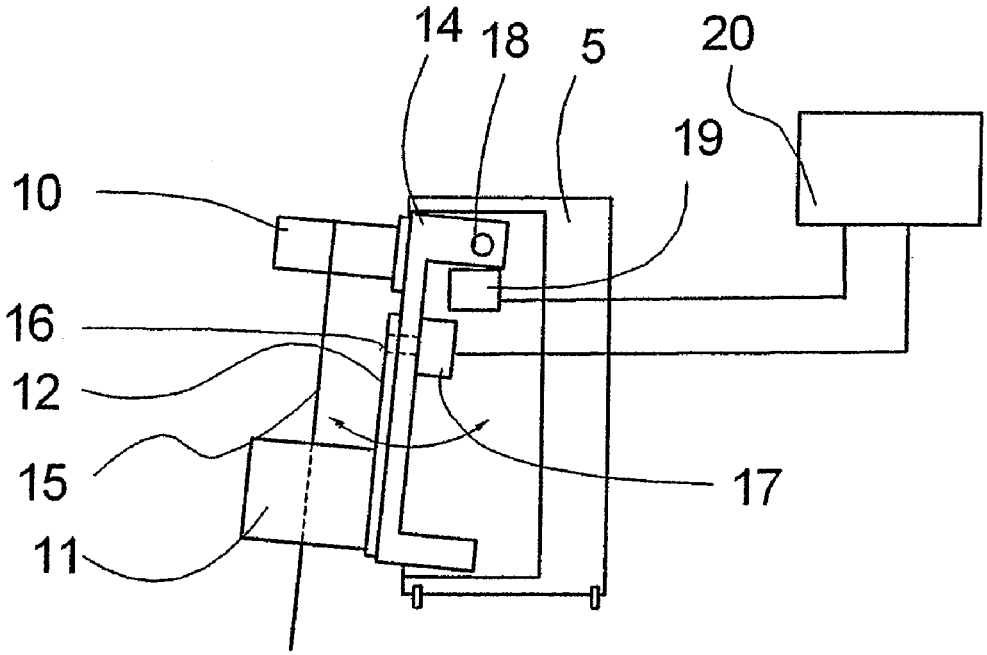
Fig.2.2

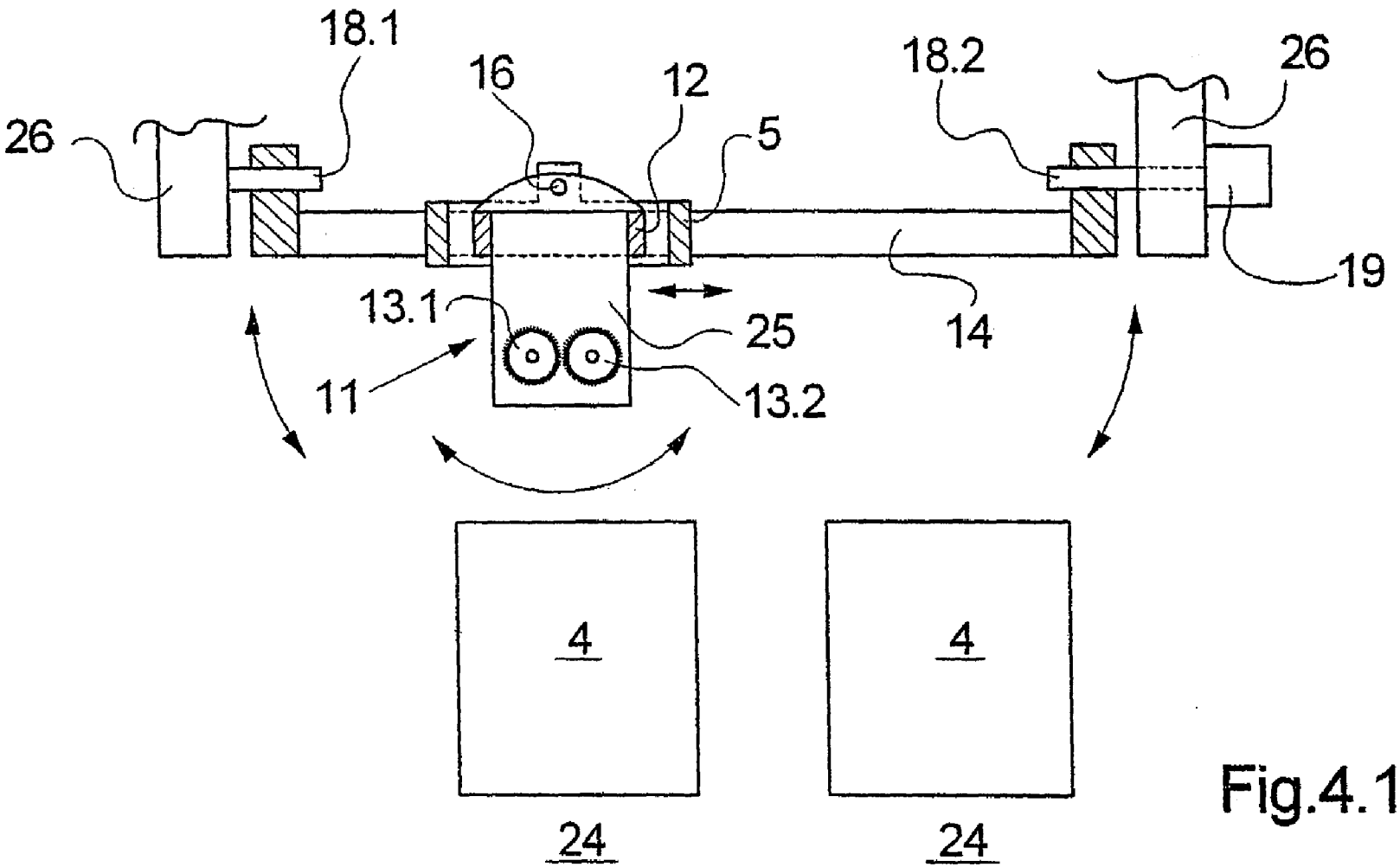
Fig.4.1

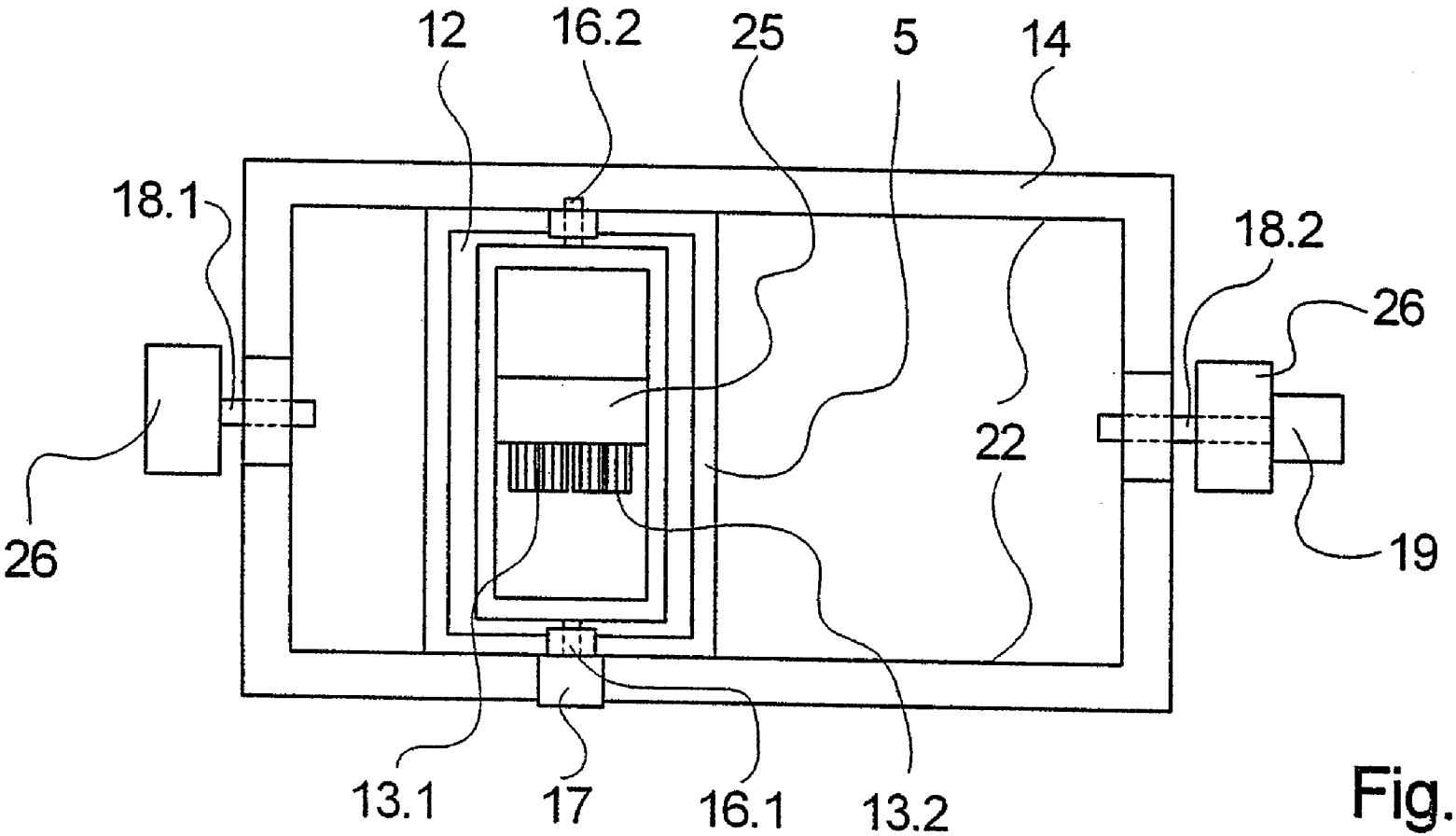
Fig.4.2

APPARATUS FOR DEPOSITING A FILAMENT TOW

CROSS REFERENCE TO RELATED APPLICATIONS

This is a DIV of U.S. application Ser. No. 10/453,197, filed Jun. 3, 2003, now U.S. Pat. No. 7,107,740, which is incorporated herein by reference.

FIELD OF THE INVENTION

The invention relates to an apparatus for depositing an advancing filament tow in which the filament tow is conveyed into a stationary can by a conveyance means, and while continuously changing the feed position of the tow into the can.

BACKGROUND OF THE INVENTION

A generic method and a generic apparatus for depositing filament tow in a can is known from European Patent Application 101 35 92 A1, for example.

In the melt spinning of individual or multiple fiber bundles, the fiber bundles are deposited in the form of a filament tow in a can for intermediate storage so that the filament tow may be supplied for further processing. It is necessary that a relative motion be carried out between the filament tow supply and the can in order to maintain uniform filling of the can. To this end, there are basically two different variants known from the prior art. In a first variant, the can is moved relative to the feed position using a cross-winding device. Such methods and devices which are known from European Patent Application 0 875 477 A2, for example, have the disadvantage that the can to be filled must be moved, which requires a considerable expenditure of energy, particularly at the end of filling, and correspondingly large drive designs.

In a second variant the can is stationary during filling. When being fed into the can the filament tow is moved by additional means in the form of a rotating plate. This variant is known from European Patent Application 101 35 92 A1, on which the present invention is based.

In the known method and the known apparatus, the filament tow is rotatably moved by means of a rotatably driven rotating plate. The rotating plate is eccentrically secured in a rotatable bearing plate, which is superimposed on the motion of the rotating plate. A conveyance means is situated upstream from the rotating plate, which continuously guides the filament tow to the rotating plate. Positioned on the rotating plate is a guide tube in which the filament tow is guided.

The known method and the known apparatus have the significant disadvantage that when the filament tow is deposited, twisting is created in the filament tow on account of the rotational motion of the rotating plate and the bearing plate, which has a particularly disadvantageous effect for thick filament tows when they are subsequently withdrawn from the can. Furthermore, as the result of additional guiding means the conveyance of the filament tow into the can is hindered by additional turns, so that only low filling densities can be achieved inside the can when the filament tow is being deposited.

It is the object of the present invention to provide an improved apparatus of the aforementioned type wherein the filament tow is conveyed, without twisting, into a stationary can in a straight course and wherein the tow may be deposited with a uniform filling density into the can.

SUMMARY OF THE INVENTION

The above and other objects and advantages of the present invention are achieved by the provision of an apparatus for depositing a filament tow in which the filament tow is conveyed into a stationary can by a conveyance means, and for deposition into the can the filament tow is guided in such a way that the feed position of the filament tow constantly changes in the can. The conveyance means comprises a pair of driven reels which cooperate with one another for conveying the tow into the can in a conveyance direction, and the conveyance means is mounted to a first member which is mounted to a second member so as to permit a first oscillating motion of the first member and the conveyance means in a direction which is transverse to the conveyance direction. The second member is mounted so as to permit a second oscillating motion of the second member in a direction which is transverse to the conveyance direction and transverse to the first oscillating motion. A first drive is provided for imparting the first oscillating motion and a second drive is provide for imparting the second oscillating motion.

Preferably, the first and second drives are independently controllable. Also, in one embodiment, the first member comprises a rocker which is pivotally connected to the second member for pivotal movement about a first generally horizontal axis so as to provide the first oscillating motion, and the second member comprises a second rocker which is pivotally connected to the holder for pivotal movement about a second generally horizontal axis which is substantially perpendicular to the first horizontal axis and so as to provide the second oscillating motion. In another embodiment, the second member comprises a carriage which is mounted to the holder for linear back and forth movement so as to provide the second oscillating motion.

In still another embodiment, the first member is pivotally mounted to a holder and the holder is mounted to the second member, with the second member being pivotally mounted to the machine frame so as to provide the second oscillating motion. The holder is displaceable along a linear guide on the second rocker for back and forth movement between at least two depositing positions.

The invention has the particular advantage that the filament tow is conveyed directly into the can and deposited without additional guiding means. To this end, the oscillating motions of the conveyance means achieve the motion of the filament tow for deposition in the can during conveying. As a result, the conveyance direction constantly changes so that the feed position of the filament tow into the can is specified by the conveyance direction. Two particular advantages in the deposition of the filament tow are thus realized. The first is that the energy introduced to the filament tow via the conveyance means can be used without restriction for creating a high filling density. The second is that, on account of the oscillating motions, the running characteristics of the filament tow are not changed. The filament tow is guided directly by the conveyance means for deposition, thereby avoiding undesired overlay effects in the filament tow. The filament tow is deposited in the can completely free of twists.

To obtain uniform two superimposed oscillating motions of the conveyance means guide filling of the can, in a first advantageous refinement of the invention the filament tow.

The directions of the two motions are aligned transversely with respect to one another, thus enabling every region in the can to be filled uniformly.

The motions may basically be performed by an oscillating pivot of the conveyance means and/or by an oscillating linear motion of the conveyance means. In this way, the conveyance means may be advantageously designed using two superimposed pivot motions, or by two superimposed linear motions, or by a pivot motion and a superimposed linear motion.

The motions of the conveyance means are performed simultaneously, preferably at different speeds. Thus, for depositing the filament tow a motion of the conveyance means corresponding to a transverse motion is preferably performed quickly so that the filament tow is laid back and forth in a longitudinal direction to fill the can. In contrast, the second motion is performed slowly so that the layers of filament tow lie close to one another inside the can.

According to one particularly advantageous method variant, the speeds of motion of the conveyance means are changed and set independently of one another to enable adjustments to the geometry of the can and to the condition and size of the filament tow to be made. It is also possible to change the deflection path taken during the motion.

For carrying out the method, an apparatus according to the invention is provided in which the movable support which bears the conveyance means is associated with at least one drive, so that during conveying the conveyance means is continuously guided in oscillating motions transverse to the conveyance direction. Thus, the conveyance direction constantly changes during conveying of the filament tow, so that the filament tow occupies a continually changing feed position in the can. The particular advantage of the apparatus according to the invention is that the filament tow is conveyed and guided into the stationary can solely by the conveyance means.

A particularly simple and effective possibility for uniformly depositing the filament tow over the entire cross section of a can may be realized by the advantageous refinement of the apparatus according to the invention, in which two movable supports are associated with the conveyance means. Each of the movable supports is driven by respective independently controllable drives to perform an oscillating motion, the directions of motion of the supports being aligned transversely with respect to one another.

To enable the actual function of the conveyance means to be carried out essentially without limitation, in a particularly preferred embodiment, the support is formed by a rocker, which bears the conveyance means. The rocker is associated with a drive to achieve, for example, a more rapid pivot motion for depositing the filament tow.

The superimposed second motion of the conveyance means may be accomplished by placing the rocker bearing on a second rocker or securing it to a carriage. In this manner, an associated drive causes the second rocker or the carriage to perform a slow motion in a superimposed manner for guiding the first rocker, and thus for guiding the conveyance means.

To enable the cans to be exchanged as rapidly as possible after a can is filled, a holder is provided which secures at least the conveyance means and a support and which can be guided between multiple depositing positions. After filling, the conveyance means may thus be quickly guided to another depositing position using an empty can.

For uniform and intensive conveying of the filament tow, the conveyance means is preferably formed by two driven reels. The reels are driven independently of the changes in position of the reels, which are initiated by the supports.

The method according to the invention and the apparatus according to the invention are particularly suited for depositing thick filament tows having fiber bundles with large spinning titers of >12,000 dtex, for example, which in particular are used for further processing of staple fibers. To this end, the apparatus according to the invention is situated downstream from a spinning device, which spins one, or more fiber bundles from a polymer melt.

BRIEF DESCRIPTION OF THE FIGURES

The apparatus according to the invention is described in greater detail below, using several exemplary embodiments with reference to the attached figures.

FIG. 2.1 schematically shows an undeflected position of the conveyance means of FIG. 1.

FIG. 2.2 schematically shows a deflected position of the conveyance means of FIG. 1.

FIG. 4.1 shows a depositing apparatus schematically illustrated in a cross-sectional view.

FIG. 4.2 shows a top view of the apparatus.

DESCRIPTION OF THE PREFERRED EMBODIMENTS

Figure 1:
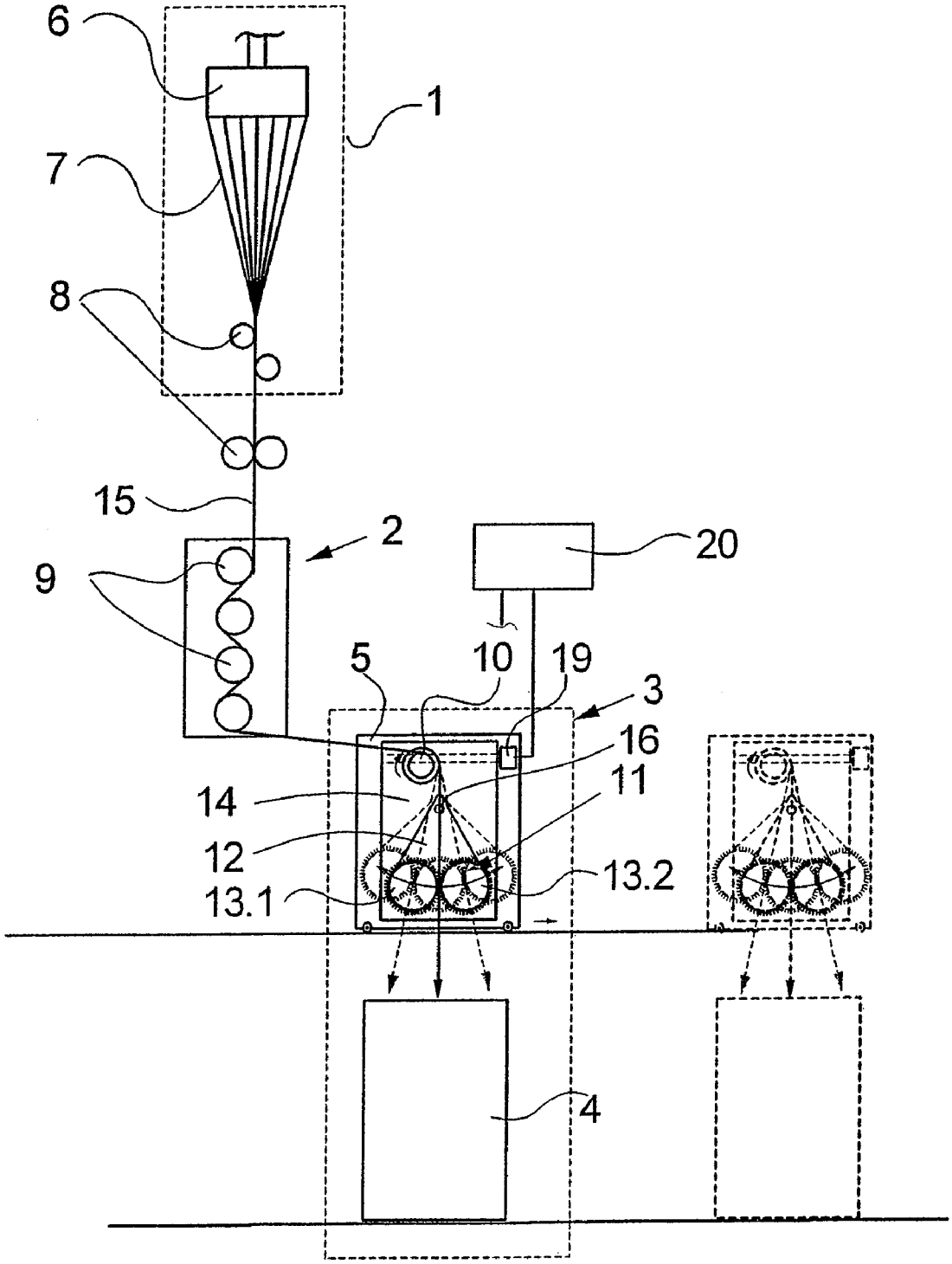
FIG. 1 schematically shows a first exemplary embodiment of the apparatus according to the invention, with a spinning device situated upstream.

FIG. 1 schematically shows a first exemplary embodiment of the apparatus according to the invention for carrying out the method according to the invention, with a spinning device situated upstream. The apparatus according to the invention is denoted by reference number 3 in FIG. 1, and is referred to hereinafter as the depositing device. A spinning device 1 and take-off unit 2 are situated upstream from depositing device 3. Depositing device 3 comprises a conveyance means 11 and a can 4.

Spinning device 1 has a spinneret 6, which extrudes a fiber bundle 7. Spinneret 6 may have more than 80,000 nozzle holes. Spinning device 1 typically has cooling devices underneath the spinneret, which produce a cold air stream for cooling the fiber bundle. The cooling device is not illustrated in this example. The number of spinnerets in spinning device 1 is also by way of example. Thus, two, three, four, five, or even more spinnerets may be configured in parallel, each extruding a fiber bundle. To combine fiber bundles 7 to obtain filament tow 15, multiple preparation devices 8 may be positioned between spinning device 1 and take-off unit 2. A preparation agent is applied to the fiber bundle and filament tow 15. When multiple spinnerets are used, all the fiber bundles may be combined into a filament tow by means of the preparation device or preparation rollers.

The take-off unit contains multiple take-off rollers 9 which are partially wrapped by filament tow 15. Filament tow 15 is drawn from spinneret 6 by take-off rollers 9 and is guided to depositing device 3.

Depositing device 3 has conveyance means 11 formed from two reels 13.1 and 13.2, which are cooperatively driven. Conveyance means 11 is guided above can 4 in a holder 5.

To explain depositing device 3, in addition to FIG. 1, reference is also made to FIGS. 2.1 and 2.2, which in addition to the front view schematically illustrated in FIG. 1 provides a side view of depositing device 3 without a can. The depositing device is shown in FIG. 2.1 in an undeflected position for conveyance means 11, and in FIG. 2.2 in a deflected position for conveyance means 11. The following description applies to both FIG. 1 and FIGS. 2.1 and 2.2 unless express reference is made to one of the figures.

Conveyance means 11 is secured on a first member or rocker 12. Rocker 12 is rotatably supported on a second member or rocker 14 via a pivot axis 16. First rocker 12 is associated with a first drive 17 by which first rocker 12 is driven in an oscillating manner, so that conveyance means 11 undergoes a pivotal motion, as shown by a dashed line in FIG. 1.

Second rocker 14 bears a feed roller 10 above first rocker 12 by which the supplied filament tow 15 is turned and guided to conveyance means 11. Second rocker 14 is pivotally secured to a bearing journal 18 situated on holder 5. Second rocker 14 is associated with a second drive 19 by which second rocker 14 is guided in a direction of motion that is transverse to the pivotal direction of first rocker 12. A control device 20 connects drives 17 and 19.

Holder 5 is configured to be displaceable in order to alternate between two depositing positions for filament tow 15. The second depositing position for filament tow 15 is illustrated by dashed lines in FIG. 1.

In the arrangement shown in FIG. 1, a filament tow 15 is provided via spinning device 1 and take-off unit 2 for depositing into a can. Filament tow 15 is conveyed by the conveyance means in the direction of provided can 4. To achieve uniform filling of can 4, first drive 17 of first rocker 12 is actuated by control device 20 in such a way that a continuously oscillating pivotal motion is initiated at the first rocker, so that conveyance means 11 is guided back and forth in a first direction of motion. This changes the conveyance direction of filament tow 15, which is denoted by the dashed arrows in FIG. 1.

To achieve a transverse direction of deflection for conveyance means 11, the position of first rocker 12 is changed by means of second rocker 14. FIGS. 2.1 and 2.2 illustrate the situation in which second rocker 14 is pivoted by second drive 19. The pivotal motion of second rocker 14 is performed in an oscillating manner at a lower speed to achieve uniform filling of can 4.

Filament tow 15 is continuously conveyed into can 4 in each deflected position of conveyance means 11. Thus, each of the feed positions inside can 4 is specified by the constantly changing conveyance direction. Filament tow 15 thus exits, without additional turns, from conveyance means 11 directly into can 4. The pivotal motion of first rocker 12 and the pivotal motion of second rocker 14 are independently adjustable via drives 17 and 19 and control device 20. The pivotal motions of rockers 12 and 14 are preferably carried out at different speeds. The pivot angle through which rockers 12 and 14 pass during the motions is such that filament tow 15 can be deposited in any region of can 4. The pivot angle of rockers 12 and 14 can be adjusted depending on the size of can 4.

In the situation illustrated in FIG. 1, the depositing positions are changed as soon as can 4 is filled with filament tow 15. To this end, holder 5 is guided into a second adjoining depositing position and fixed in place. The filament tow is cut using auxiliary devices and placed in new empty can 4.

The full can may thus be easily replaced by a new empty can.

Figure 3:
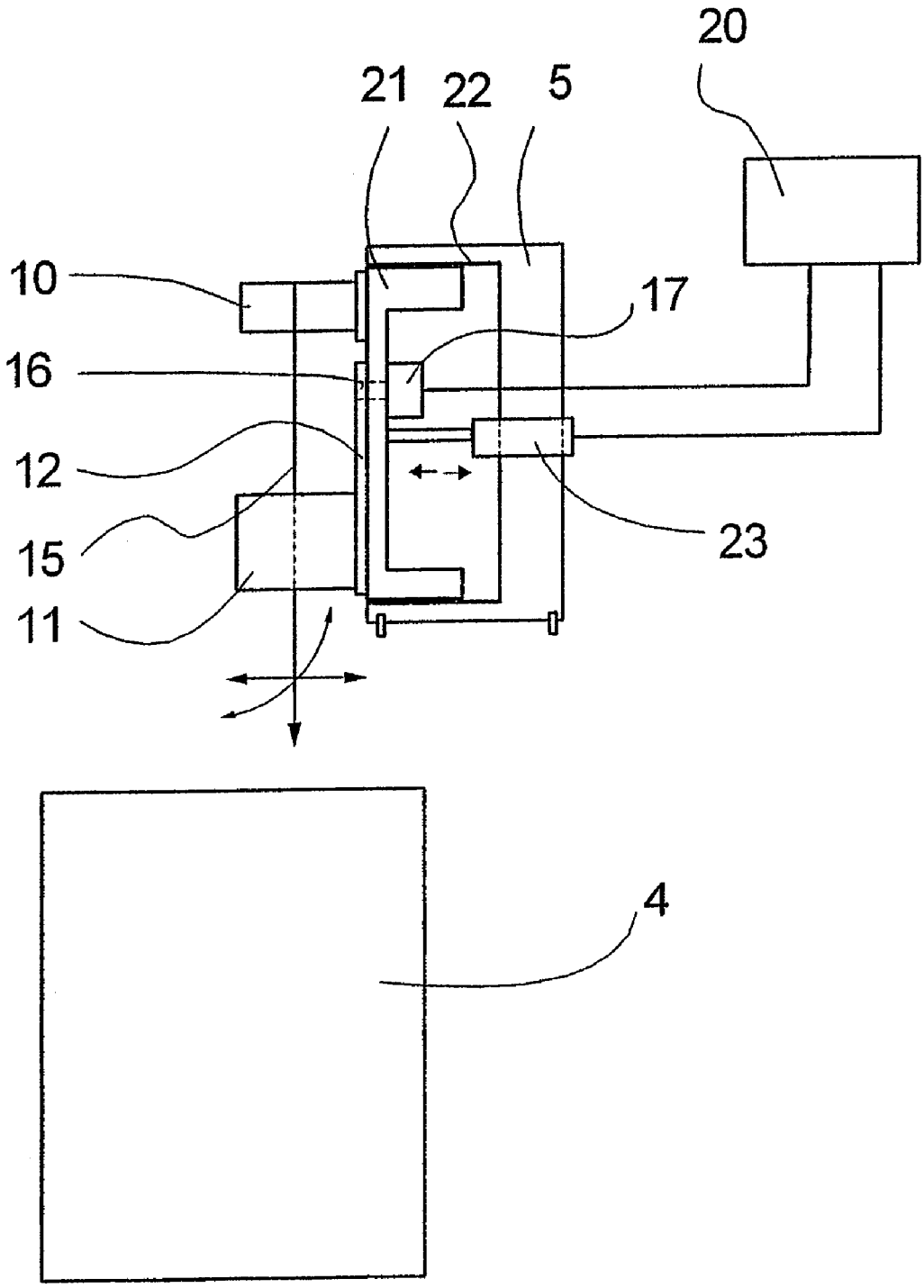
FIG. 3 schematically shows a cross-sectional view of the undeflected position shown in FIG. 2.1.

A further exemplary embodiment of a device according to the invention is schematically illustrated in a cross-sectional view in FIG. 3. The exemplary embodiment in FIG. 3 shows the depositing device, in which conveyance means 11 is guided to holder 5, and can 4 is situated underneath conveyance means 11. The function and structure of the depositing device are essentially identical to those of the preceding exemplary embodiment, so that only the differences will be pointed out here.

Here as well, conveyance means 11 is formed by two reels, which are pivotally secured to rocker 12. Rocker 12 is secured to a carriage 21 via pivot axis 16. Carriage 21 is guided to holder 5 by means of a linear guide 22. Carriage 21 is associated with linear drive 23 by which the position of carriage 21 may be changed. Linear drive 23 and drive 17 of rocker 12 are coupled to control device 20.

To guide filament tow 15 during conveying by conveyance means 11, conveyance means 11 is moved by rocker 12 in a pivotal direction transverse to the plane of the drawing, and is moved by carriage 21 and linear drive 23 in a direction of motion within the plane of the drawing. To this end, carriage 21 is moved in an oscillating manner by linear drive 23, the linear motion-taking place at a slower speed than the pivotal motion of rocker 12. The lift of carriage 21 is determined by linear drive 23, it being possible to change the lift by controlling linear drive 23.

A further exemplary embodiment of an apparatus according to the invention is schematically illustrated in several views in FIGS. 4.1 and 4.2. The exemplary embodiment in FIG. 4 shows only the depositing device, upstream from which a take-off unit and a spinning device are situated. The spinning device and the take-off unit could be designed, for example, as previously described in the exemplary embodiment according to FIG. 1. The depositing device is schematically illustrated in a cross-sectional view in FIG. 4.1, and is schematically illustrated in a top view in FIG. 4.2. For the sake of clarity, components having the same function are provided with the same reference numbers.

Conveyance means 11, which is formed by two reels 13.1 and 13.2 and a roller support 25, is borne by a first member or rocker 12. Rocker 12 is fixedly joined to roller support 25. Rocker 12 is supported on two ends on a holder 5 via pivot axes 16.1 and 16.2, which are situated opposite one another. Rocker 12 and holder 5 are each designed as a rectangular frame section, the frame section of holder 5 enclosing rocker 12 at a distance. Rocker 12 is pivotally secured to holder 5 via pivot axes 16.1 and 16.2. The pivotal motion of rocker 12 is controlled by a drive 17, which is coupled to swivel axis 16.1.

Holder 5 is guided in a linear guide 22 to a second member or rocker 14. Second rocker 14 is likewise formed by a rectangular frame section, on the long inner side of which linear guide 22 for holder 5 is provided. Holder 5 may thus move back and forth between multiple depositing positions 24 on rocker 14. Rocker 14 is pivotally supported on two ends on a machine frame member 26 by means of bearing journals 18.1 and 18.2. The pivotal motion of rocker 14 is controlled by drive 19, which is coupled to bearing journal 18.2.

In the exemplary embodiment of the depositing apparatus shown in FIG. 4, holder 5 is secured in a left-hand depositing location 24 of a rocker 14. When a filament tow is being deposited, holder 5 is locked in place on rocker 14. Reels 13.1 and 13.2 of conveyance means 11 are continuously driven when a filament tow is being deposited, so that the filament tow is fed in the direction of a can 4 secured in a depositing location 24. To fill can 4, rocker 12 is moved in an oscillating manner by drive 17 in such a way that the conveyance direction of conveyance means 11 constantly varies. The second motion of conveyance means 11 is performed by rocker 14 via drive 19. The pivotal motion of rocker 14 is slower compared to the pivotal motion of rocker 12, and serves the sole purpose of allowing the filament tow to be uniformly distributed over the entire cross section of can 4.

Electrical, electromechanical, pneumatic, or hydraulic means may be used as drives 17 and 19.

As soon as can 4 is filled, the motion of rocker 14 is stopped and holder 5 is released. Holder 5 is then guided to adjoining depositing location 24 and locked in place once again. At this time a new can may be filled with the filament tow.

The exemplary embodiments shown in FIGS. 1 through 4 are exemplary in design. In principle, all suitable apparatus for performing a motion of the conveyance means may be used to guide the filament tow during conveying in such a way that a subsequent can is uniformly filled with a high filling density. In this respect, the invention extends to all apparatus in which a stationary can is used and in which the filament tow or a similar strand-shaped material is guided solely by motion of the conveyance means.

That which is claimed:

1. An apparatus for depositing an advancing filament tow into a stationary can while continuously changing the feed position of the tow into the can, comprising conveyance means for positively conveying the tow into the can, said conveyance means comprising a pair of driven reels which cooperate with one another for conveying the tow into the can in a conveyance direction, said conveyance means being mounted to a first member, with the first member being mounted to a second member so as to permit a first oscillating motion of the first member and the conveyance means in a direction which is transverse to the conveyance direction, and a first drive for imparting the first oscillating motion to the first member and the conveyance means, said second member being mounted so as to permit a second oscillating motion of the second member in a direction which is transverse to the conveyance direction and transverse to the first oscillating motion, and a second drive for imparting the second oscillating motion to the second member and thus also to the first member and the conveyance means.

2. The apparatus of claim 1 wherein the first and second drives are independently controllable.

3. The apparatus of claim 1 wherein the first member comprises a first rocker which is pivotally connected to the second member for pivotal movement about a first generally horizontal axis so as to provide said first oscillating motion.

4. The apparatus of claim 3 wherein the second member comprises a second rocker which is pivotally connected to a holder for pivotal movement about a second generally horizontal axis which is substantially perpendicular to the first horizontal axis and so as to provide said second oscillating motion.

5. The apparatus of claim 4 wherein the holder is displaceable along a linear guide for back and forth movement between at least two depositing positions.

6. The apparatus of claim 3 wherein the second member comprises a carriage which is mounted to a holder for linear back and forth movement in a direction which is substantially parallel to the first horizontal axis so as to provide said second oscillating motion.

7. The apparatus of claim 6 wherein the holder is displaceable along a linear guide for back and forth movement between at least two depositing positions.

8. The apparatus of claim 3 wherein the conveyance means further comprises a feed roller mounted to the second member upstream of the pair of driven reels.

9. An apparatus for depositing an advancing filament tow into a stationary can while continuously changing the feed position of the tow into the can, comprising conveyance means for positively conveying the tow into the can, said conveyance means comprising a pair of driven reels which cooperate with one another for conveying the tow into the can in a conveyance direction, said conveyance means being mounted to a first member, with the first member being pivotally mounted to a holder so as to permit a first oscillating motion of the first member and the conveyance means in a direction which is transverse to the conveyance direction, and a first drive for imparting the first oscillating motion to the first member and the conveyance means, said holder being mounted to a second member, with the second member being pivotally mounted to a machine frame so as to permit a second oscillating motion of the second member in a direction which is transverse to the conveyance direction and transverse to the first oscillating motion, and a second drive for imparting the second oscillating motion to the second member and thus also to the holder, the first member, and the conveyance means.

10. The apparatus of claim 9 wherein the first member comprises a first rocker which is pivotally connected to the holder for pivotal movement about a first generally horizontal axis so as to provide said first oscillating motion.

11. The apparatus of claim 10 wherein the second member comprises a second rocker which is pivotally connected to the machine for pivotal movement about a second generally horizontal axis which is substantially perpendicular to the first horizontal axis and so as to provide said second oscillating motion.

12. The apparatus of claim 11 wherein the holder, together with the first rocker and the conveyance means, are displaceable along a linear guide on the second rocker for back and forth movement between at least two depositing positions.

13. The apparatus of claim 11 wherein the first and second drives are independently controllable.

* * * * *